US005775427A

United States Patent [19]

Skeels et al.

[11] Patent Number: 5,775,427

[45] Date of Patent: Jul. 7, 1998

[54] INTERNALLY LATCHED SUBSEA WELLHEAD TIEBACK CONNECTOR

[75] Inventors: Harold B. Skeels, Kingwood; Bashir M. Koleilat, Spring; Shiva Singeetham, Houston, all of Tex.

[73] Assignee: FMC Corporation, Chicago, Ill.

[21] Appl. No.: 748,700

[22] Filed: Nov. 13, 1996

[51] Int. Cl.[6] ..... E21B 43/013

[52] U.S. Cl. ..... 166/344; 166/359; 285/39; 285/315

[58] Field of Search ..... 166/345, 348, 166/359, 344; 285/39, 315

[56] References Cited

U.S. PATENT DOCUMENTS

| | | | |
|---|---|---|---|
| 4,408,783 | 10/1983 | Gruller | 285/3 |
| 4,519,633 | 5/1985 | Nichols | 285/3 |
| 4,749,045 | 6/1988 | Gano | 166/344 |
| 4,872,708 | 10/1989 | Abreo, Jr. | 285/39 |
| 4,893,842 | 1/1990 | Brammer | 285/24 |
| 4,941,691 | 7/1990 | Reimert | 285/39 |
| 5,069,288 | 12/1991 | Singeetham | 166/348 |
| 5,163,514 | 11/1992 | Jennings | 166/368 |
| 5,168,933 | 12/1992 | Pritchard, Jr. et al. | 166/348 |
| 5,174,376 | 12/1992 | Singeetham | 166/208 |
| 5,259,459 | 11/1993 | Valka | 166/345 |
| 5,299,642 | 4/1994 | Nelson et al. | 166/368 |
| 5,503,230 | 4/1996 | Osborne et al. | 166/344 |
| 5,566,761 | 10/1996 | Pallini, Jr. et al. | 166/345 |

*Primary Examiner*—Hoang C. Dang
*Attorney, Agent, or Firm*—Henry C. Query, Jr.

[57] ABSTRACT

A subsea wellhead tieback connector operatively used to connect to a marine riser pipe or a well conductor in a manner that that will not unthread or unloosen the joints of the riser pipe being unlocked. The tieback connector operates with a novel internal latching mechanism having a hydraulic piston, an inner body that stretches and deflects in a unique manner resulting in compression spring forces at two locations, an expanding lock ring, a threaded adjustment ring, and a reaction ring. During operation the tieback connector creates an enhanced mechanical advantage to originate a required pre-load force without the necessity of having to generate a large hydraulic force that would otherwise be needed.

22 Claims, 3 Drawing Sheets

INTERNALLY LATCHED SUBSEA WELLHEAD TIEBACK CONNECTOR

BACKGROUND OF THE INVENTION

The present invention relates to subsea wellhead and pipe connectors, and more particularly to axially latching connectors for tying back to subsea wellheads with well conductor or riser pipe.

The development of offshore petroleum oil and gas deposits from undersea wells involves drilling production wells in the sea bed from a drilling platform, and then capping the wellhead at the ocean floor until a production platform, either stationary or floating, is put into place on the surface. To commence production from a subsea well, large diameter marine riser pipe is run downward from the production platform and connected to the subsea wellhead, a procedure generally referred to as tying back to the wellhead.

Several types of tieback connectors are available to connect the riser to the wellhead. Certain of these connectors require rotation of a riser string to lock them to, and release them from, the wellhead housing. However, when rotating to the left to unlock the connector, the joints in the riser string tend to unthread and loosen. Reconnecting these loosened joints can be a serious and costly problem to the operator.

To solve this problem, tieback connectors that are actuated by axial movement have been developed to provide a connection to, and disconnection from, a wellhead without rotary motion. In certain of such connectors, a pre-load can be imposed through the connector's lock ring and onto the wellhead housing. Prior devices also include adjustment of the pre-load through cumbersome changes between the relative positions of the inner body and outer body forming such connectors. However, such connectors are not constructed to provide an adequate pre-load force between a lock ring on the connector and the wellhead, and may not be adequate to maintain the locking force under the extreme pressures encountered which tend to separate the riser from the wellhead.

One approach is disclosed in U.S. Pat. 5,259,459 to Valka titled "Subsea Wellhead Tieback Connector" which is directed to a wellhead tieback connector actuated solely by axial motion to achieve connection and disconnection from the subsea wellhead using a type of expanding lockdown ring and a type of adjustment assembly. After the connection is made between the tieback connector and the wellhead, the apparatus taught by this patent is used to effectuate a rigid lockdown, thereby eliminating any slippage that exists in the manufacturing or installation tolerances in the riser pipe being connected.

The advent of spar-type floating production facilities has increased the need for a premium, high force-resistant, tieback connection system for affixing a riser pipe conduit from pre-drilled subsea wellheads to completion trees at the surface within the spar's structure. One unique problem that a spar presents is the limited space from which to lower and install a riser pipe conduit and tieback connector since the inside diameter of the pipe will only permit passage of equipment 26 inches in diameter or smaller.

In addition to the small profile requirements, the subsea tieback connection system must be resistant to extreme external bending and axial loads in addition to the pressures generated from the well. A tieback connection system is required which can generate sufficient locking force to resist separation forces in excess of 800,000 pounds, which is often referred to as a connector's pre-load force.

SUMMARY OF THE INVENTION

To generate this force in a tieback connector, the present invention provides a structure wherein the relative location between a recessed groove in the wellhead and a lock ring forming part of the tieback connector can be readily adjusted to provide maximum pre-load. The lock ring is actuated to expand into the wellhead groove, and beveled engagement surfaces on the lock ring and wellhead groove provide the necessary pre-load.

In accordance with the present invention, there is provided a tieback connector that has a tubular outer body that is adapted to rest axially upon an upper surface of the wellhead. The tieback connector has an inner body that is adapted to extend partially into an inner diameter of the wellhead. The tieback connector has an energizing piston that extends axially between the wellhead and the inner body, the piston including actuating means disposed between the inner body and the outer body for selectively moving the piston in an axial direction. A lock ring extends circumferentially around a portion of the inner body, the lock ring positioned beneath a lower end surface of the energizing piston, axial movement of the energizing piston in one direction expanding the lock ring into a locking engagement with a wellhead component for connecting the tieback connector to the wellhead component. An adjusting ring extends around and is operatively connected to the inner body, the adjusting ring positioned beneath and in contact with a surface of the lock ring, the adjusting ring capable of axial movement to alter the axial position of the lock ring relative to the inner body to establish an adjustable preload on the lock ring when the lock ring is in locking engagement.

The structure of the present invention provides a significant mechanical advantage between a hydraulically actuated piston assembly and the lock ring which compresses the lock ring into the wellhead groove. Further, the tieback connector of the present invention is specifically constructed whereby mating locking parts under compressive pressure in the subject connector bend and/or buckle to create a compressive spring pre-load force.

To accomplish a high force-resistant tieback connection pursuant to the above objectives, the expanding lock ring of the connector is positioned a short distance above the recessed groove in the wellhead such that upon contact, the tapered shoulders between the lock ring and wellhead groove stretch the connector body down until the lock ring fully enters the groove, thus developing sufficient pull force to generate pre-load. The relative position of the lock ring to the wellhead groove is adjusted by a threaded cylinder or adjustment ring disposed in axial contact with the lock ring. Rotation of the adjustment ring imparts axial movement to the lock ring to accommodate differences in machining tolerances between the wellhead housing and the tieback connector, and to pre-apply the desired amount of pre-load.

To provide the necessary mechanical advantage between the lock ring and a hydraulic piston which expands the lock ring into the wellhead groove, without having to generate a large hydraulic force, radii are provided on the piston and lock ring surfaces which are in contact as the piston is actuated. When the two contact surfaces of the piston and lock ring pass by each other during the locking process, a small relative angle is taken by the load path, resulting in a significant mechanical advantage between the two parts, in the range of 27:1 in the preferred embodiment of the invention. By way of example, in one embodiment of the present invention, a 1700 psi hydraulic pressure acting on an 18.49 square inch piston generates approximately 29,500 pounds of downward force, which translates to 810,000 pounds of pre-load locking force acting on the lock ring.

A further feature of the present invention is to provide certain parts having a design geometry such that these parts bend or buckle to create a compressive spring pre-load force. This compressive spring force is introduced by making the adjustment ring and locking piston long and slender, whereby deflection is provided under load. Since both of these elements are fully captured on all sides by more rigid components, the deflection or buckling of these two parts is restrained against failure and therefore the two parts are fully supported. The stored energy of the adjustment ring and the locking piston, in combination with the stretch associated with axially loading the tieback connector's main body, provide the necessary stretch and stored energy for generating the required pre-load.

DETAILED DESCRIPTION OF THE PREFERRED EMBODIMENT

Figure 1:
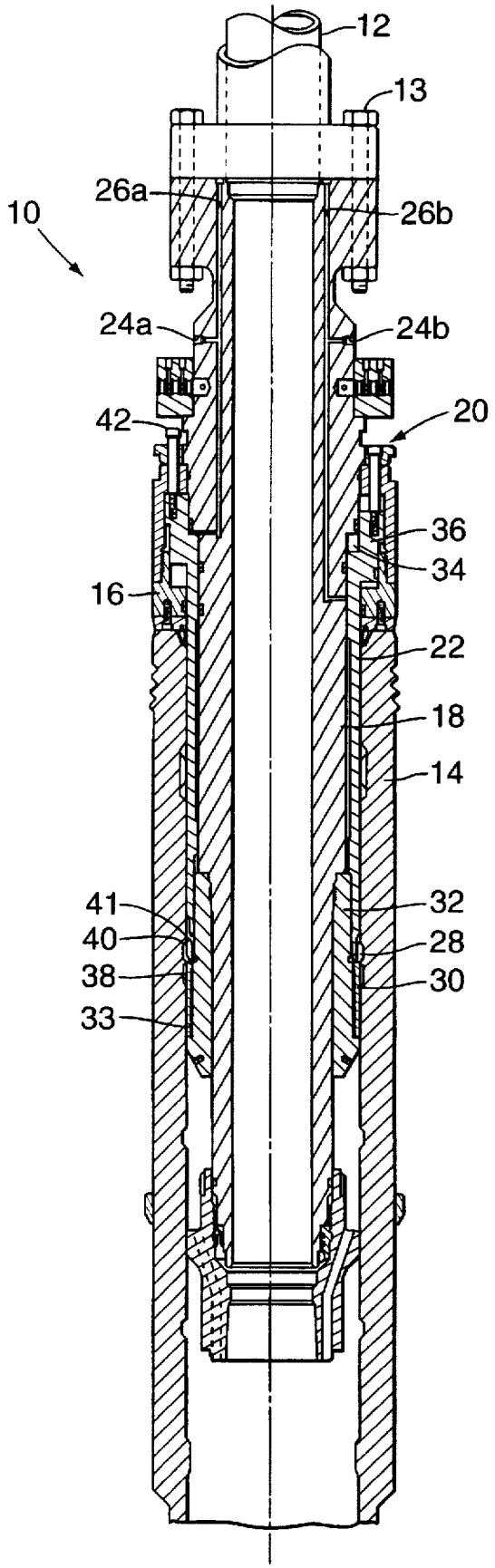
FIG. 1 is a fragmentary central sectional view through a tieback connector of the present invention, depicting the connector and internal seals positioned in a wellhead housing and illustrates (at the left side of FIG. 1 prior to actuation of the connector) the energizing piston in its prestroke position and the lock ring in its retracted position, and also illustrates (at the right side of FIG. 1 after actuation of the connector) completion of the piston stroke with the energizing piston in its radial hoop compression position behind the lock ring and with the adjustment ring in compression.

FIG. 1 is a fragmentary central sectional view through a tieback connector that is constructed in accordance with the present invention, depicting the connector and internal seals positioned in a wellhead housing and illustrates at the left side of FIG. 1 the energizing piston in its prestroke position and the lock ring in its retracted position, and also illustrates at the right side of FIG. 1 completion of the piston stroke with the energizing piston in its radial hoop compression position behind the lock ring and with the adjustment ring in compression. In FIG. 1, a tieback connector 10 is connected to bottom of a section of riser pipe 12 by suitable means such as bolts 13. Tieback connector 10 in turn is removably connected to a wellhead housing 14 in a manner to be described below. The wellhead housing 14 remains fixed and stationary during operation of the tieback connector 10.

The tieback connector 10 comprises a tubular outer body 16, a tubular inner body 18 and a hydraulic piston assembly 20 that contains an energizing piston 22 and associated hydraulic supply lines **24*a* and 24*b* contained within piston actuation channels 26*a* and 26*b*, respectively. Tieback connector 10 also comprises an expanding lock ring 28, a threaded adjustment ring 30, and a fixed reaction ring 32 which is fixedly connected to inner body 18 by any suitable means, such as by threaded engagement. The adjustment ring 30 is located beneath the expanding lock ring 28. The adjustment ring 30 is threaded, or otherwise suitably connected, with threads 33 to the reaction ring 32, and can be manually rotated prior to lowering tieback connector 10 to wellhead 14**.

The energizing piston 22 is caused to move within an associated lifting chamber 34 by hydraulic pressure applied through actuation channels **26*a* and 26*b*. The piston has a single-piece piston top 36 located in chamber 34. Application of hydraulic pressure to channel 26*a* forces piston top 36 and, thus, piston 22 downward, while application of pressure to channel 26*b* forces piston top 36 and piston 22** upward.

During operation of the tieback connector 10, the energizing piston 22 of the hydraulic piston assembly 20 operates to force an expanding lock ring 28 into a recessed groove 38 that is machined into the interior surface of the wellhead housing 14. The recessed groove 38 has a tapered entry 40 extending upwardly and radially inwardly from groove 38. The expanding lock ring 28 has a complimentary beveled edge or tapered shoulder 41 and is spaced to facilitate its tapered entry into the recess 38 during operation of the energizing piston 22, and operates in a manner to cause the body of the tieback connector 10 to stretch as the expanding lock ring 28 moves along the tapered entry 40 of the groove 38 (see FIGS. 3 and 4). There is a visual indicator 42 to depict the position of the energizing piston 22, and when visible indicates that the piston is in its prestroke position.

The amount of force able to be created or generated is a function of two features contained in the tieback connector 10, namely, (1) the relative location between the wellhead housing's recessed groove 38 and the expanding lock ring 28, and (2) the mechanical advantage between the energizing piston 22 and the expanding lock ring 28.

The relative location is created by positioning the expanding lock ring 28 a few thousandths of an inch above the recessed groove 38. If the expanding lock ring 28 were to be positioned or spaced at the same location as the recessed groove 38, the lock ring would simply expand into the recessed groove 38, and not exert any force or push up on the tapered entry 40 of the groove 38, thereby not creating any of the required pull force that is necessary in order to effectuate or generate the pre-load force required for the tieback connector. However, since the expanding lock ring 28 is located and positioned above the recessed groove 38, the tapered shoulders 41 of the lock ring 28 will come into contact with the tapered entry 40 of groove 38, which directly causes the resulting stretching of the body of the tieback connector until the lock ring can fully enter the recessed groove. Note, that the greater the relative distance, the greater will be the resulting stretching (or pre-load) force that will be caused to be generated. The relative position of the lock ring 28 with respect to the recessed groove 38 is controlled by the threaded adjustment ring 30, which operates as a threaded cylinder, that is positioned and located just below the expanding lock ring 28, which the adjustment ring contacts. The adjustment ring 30 is threaded so that it can be manually rotated vertically up or down relative to reaction ring 32 to accommodate differences that will exist in the machining tolerances between the wellhead housing 14 and the tieback connector 10. This allows the specific amount of pre-load force desired to be simply dialed-in (e.g., as the higher the adjustment ring 30 is moved, the greater the amount of pre-load will be generated).

The structure of the tieback connector produces the mechanical advantage that is required to facilitate and generate the high pre-load force of the connector without the need to generate a large associated hydraulic force that would otherwise be required for the connector. This is accomplished as a result of the physical geometries between the energizing piston 22 and the expanding lock ring 28 with respect to each's respective radii on the respective surfaces that are present at the location of contact between the piston and the lock ring. When the energizing piston 22 and the lock ring 28 touch and roll by each other over the radiused surfaces during the locking process, the relative angle that the load path takes is very small. This action creates an enhanced mechanical advantage between the two parts, on the order of approximately 27:1 in the preferred embodiment of the invention. Accordingly, a 1700 psi hydraulic pressure acting on an 18.49 square inch piston generates approximately 29,500 lbs. downward force, which is translated to 810,000 lbs. of locking force acting on the lock ring 28.

Figure 2:
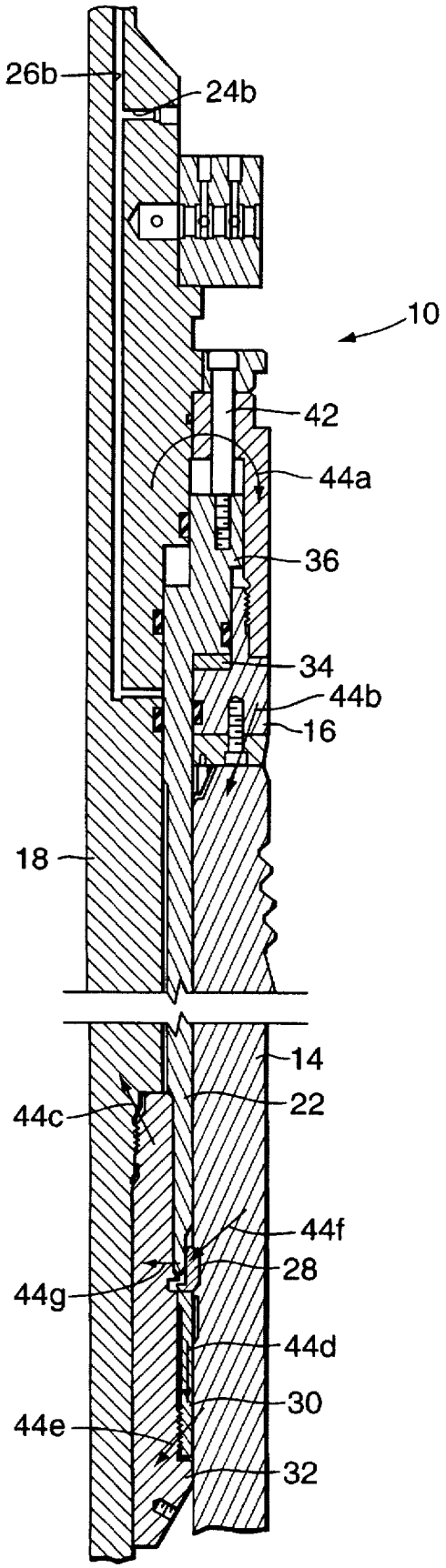
FIG. 2 is a partial fragmentary view of the tieback connector of the present invention as shown in FIG. 1, depicting pre-load compression during the actuation of the tieback connector.

FIG. 2 is a partial fragmentary view of the tieback connector that is built in accordance with the present invention as illustrated in FIG. 1, depicting pre-load compression during the actuation of the tieback connector. In FIG. 2, the tie-back connector 10 is intended to have a certain amount of stretchiness during operation. Accordingly, the inner body 18 is stretched when pre-loaded between reaction ring 32 and wellhead 14. The dynamic load path is indicated by load path arrows 44*a*, 44*b*, 44*c*, 44*d*, 44*e*, 44*f* and 44*g*. If each of the components for the tieback connector 10 were infinitely stiff, the expanding lock ring 28 would engage the tapered entry 40 on the recess groove 38 and then stop moving, regardless of the position or setting of the lock ring 28. In such case, there would not be sufficient hydraulic force on the tieback connector to cause the body of the tieback connector to stretch and thereby generate the required pre-load force necessary to operate the connector. To introduce and facilitate stretch, the geometry of certain parts must be made sufficiently slender to deflect, bend and/or buckle in a predetermined manner or fashion to create a resulting compressive spring force, which is the connector's required pre-load force. This compression spring force is introduced within the connector by making the adjustment ring 30 and locking energizing piston 22 long and slender so that these parts will deflect in a predetermined manner when under a sufficient load. The adjustment ring 30 enters into a compression buckle to provide the compression spring force between expanding lock ring 28 and reaction ring 32 (e.g., load force marked by an asterisk). Since the adjustment ring 30 is completely captured on all its sides by more rigid components, the buckling adjustment ring (from the resulting compression spring force) has no where to go for failure and therefore is fully supported. As a result of the compression spring force, the energizing piston 22 locks-up and deflects inward, away from the expanding lock ring 28 (force marked by an asterisk), as the connector is locked, thereby providing a hoop stress deflection to provide the compression spring force. The energizing piston is also surrounded and supported by rigid bodies, thereby preventing failure.

The stored energy of these two components, namely, the energizing piston 22 and the adjustment ring 30, along with the stretch associated with axially loading the connector's inner body 18, provide the necessary stretch and stored energy for generating the required pre-load for the connector.

Figures 3, 4, 5, 6:
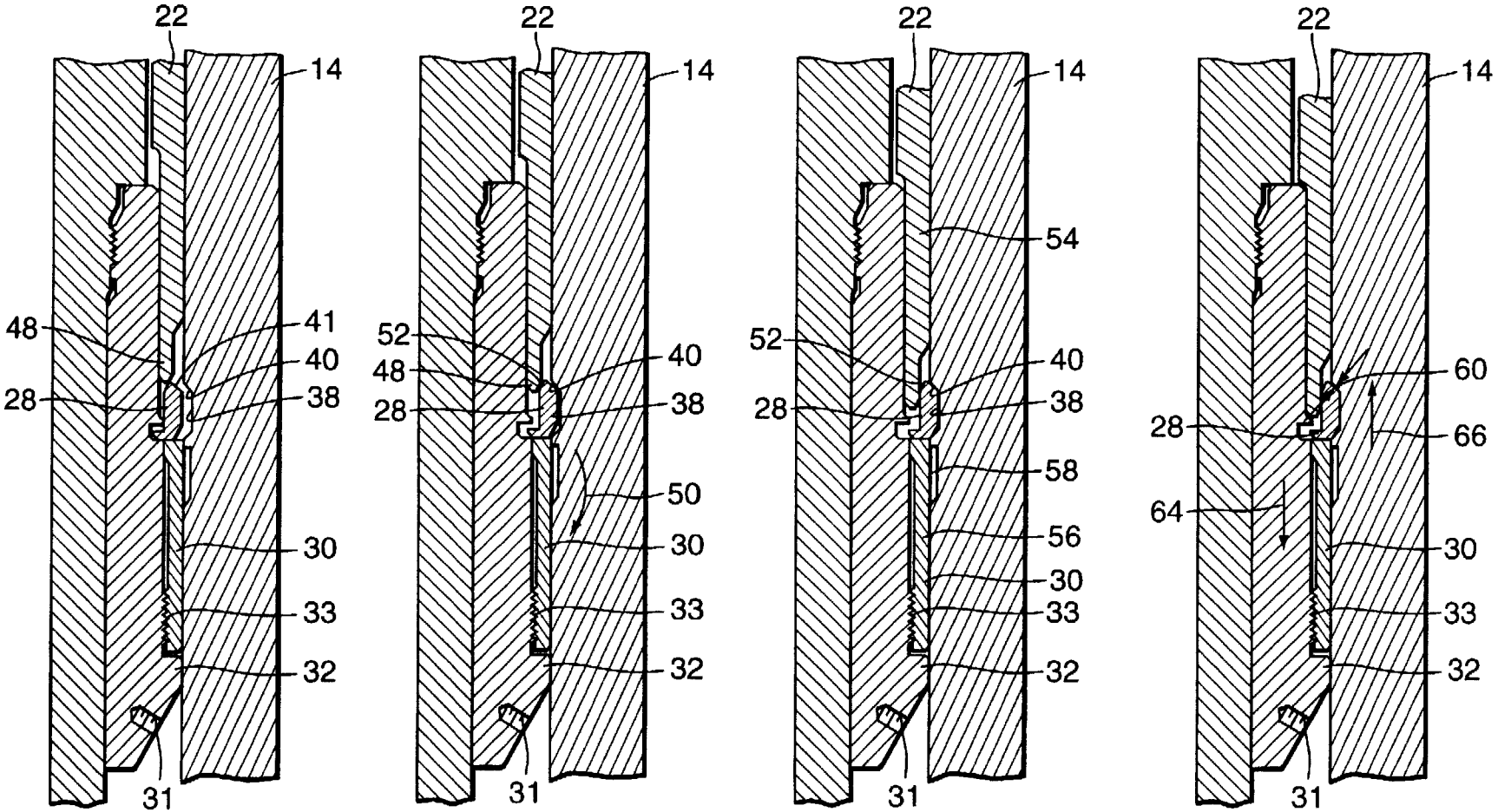
FIG. 3 is a fragmentary view of the tieback connector of the present invention as shown in FIGS. 1 and 2, depicting the energizing piston in the withdrawn position and the lock ring in the retracted position ready for actuation.
FIG. 4 is a fragmentary view of the tieback connector of the present invention as shown in FIGS. 1 and 2, depicting the energizing piston as it initializes contact with the top of the lock ring.
FIG. 5 is a fragmentary view of the tieback connector of the present invention as shown in FIGS. 1 and 2, depicting the rounded end of the energizing piston as it engages the rounded chamfer of the lock ring creating the mechanical advantage required for pre-load.
FIG. 6 is a fragmentary view of the tieback connector of the present invention as shown in FIGS. 1 and 2, depicting the energizing piston in its fully stroked position (behind the lock ring) and in a radial hoop compression and with the adjustment ring in compression.

FIG. 3 is a fragmentary view of the tieback connector that is constructed in accordance with the present invention as shown in FIGS. 1 and 2, depicting the energizing piston in the withdrawn position and the lock ring in the retracted position ready for actuation. In FIG. 3, the energizing piston 22 is in its associated pre-stroke position, and the expanding lock ring 28 is in its associated retracted position. The rounded end 48 of piston 22 is above the lock ring 28. The lock ring 28 is away from the recessed area 38 of the wellhead housing 14. Since the energizing piston 22 is in its pre-stroke position and the lock ring 28 is in its retracted position, there are no resulting load paths or compression spring forces at this time.

FIG. 4 is a fragmentary view of the tieback connector that is constructed in accordance with the present invention as shown in FIGS. 1 and 2, depicting the energizing piston as it initializes contact with the top of the lock ring. In FIG. 4, the energizing piston 22 commences its associated stroke, and as it does its rounded end 48 physically contacts the top edge 52 of the lock ring 28, which forces the lock ring 28 out into the grove 38 formed and located in the wellhead housing 14. Top edge 52 is an edge having an associated radius. During operation of the energizing piston 22, the lock ring 28 will begin to make physical contact with tapered entry 40 of recessed grove 38.

FIG. 5 is a fragmentary view of the tieback connector that is constructed in accordance with the present invention as shown in FIGS. 1 and 2, depicting the rounded end of the energizing piston as it traverses the rounded chamfer of the lock ring creating the mechanical advantage required for pre-load. In FIG. 5, as the energizing piston 22 continues its associated stroke, the rounded lower end 48 will meet continued increased pressure and resistance from the rounded surface or the rounded chamfer that is associated with lock ring 28 as the lock ring 28 seats itself in groove 38. Accordingly, the stress and dynamics of this will act to compress the width of rounded end 48, which causes the deflection and/or buckling of the top portion of energizing piston 22 at location 54. This dynamic deflection and/or buckling action will act as a spring compression force at location 54. Simultaneously, during operation of the tieback connector, resulting stress forces, and dynamic buckling and/or deflection forces occur at a location 56 in adjustment ring 30. This buckling will result in a different spring compression force to occur at location 56. Accordingly, during operation of the tieback connector, the associated load path will cause the eventual deflection and/or buckling forces at different top and bottom locations 54 and 56, the effect of which is to create associated compression spring forces in a predetermined direction at each of those two locations.

FIG. 6 is a fragmentary view of the tieback connector that is constructed in accordance with the present invention as shown in FIGS. 1 and 2, depicting the energizing piston in the fully-stroked position (behind the lock ring). In FIG. 6, the energizing piston 22 is in its fully-stroked position which simultaneously causes an inward compression spring force at location 60 as the edge of the lock ring 28 seats itself within the recessed area 38. The resulting dynamic load paths are indicated by load path arrows 64 and 66. The adjustment ring 30 will be in compression and the piston 22 will be in a radial hoop compression.

Although the foregoing detailed description of the present invention has been described by reference to a single embodiment, and the best mode contemplated for carrying out the present invention has been herein shown and described, it will be understood that modifications or variation in the structure and arrangement of that embodiment other than those specifically set forth herein may be achieved by those skilled in the art and that such modifications are to be considered as being within the overall scope of the present invention.

We claim:

1. A tieback connector for connecting a riser, conductor, or other well pipe to a subsea wellhead, said connector comprising:

(a) a tubular outer body means adapted to rest axially upon an upper surface of the wellhead;

(b) an inner body means adapted to extend partially into an inner diameter of said wellhead;

(c) an energizing piston means extending axially between said wellhead and said inner body means, said piston means including actuating means disposed between said inner body means and said outer body means for selectively moving said piston means in an axial direction;

(d) a lock ring means extending circumferentially around a portion of the inner body means, said lock ring means disposed beneath a lower end of said energizing piston means, axial movement of said energizing piston means in one direction expanding the locking ring means into locking engagement with a wellhead component for connecting the tieback connector to said component; and (e) an adjusting ring means extending around and operatively connected to said inner body means, said adjusting ring means disposed beneath and in contact with a surface of said lock ring means, said adjusting ring means capable of axial movement to alter the axial position of said lock ring means relative to said inner body means to establish an adjustable pre-load on the lock ring means when the lock ring means is in locking engagement.

2. The tieback connector of claim 1 wherein said axial movement of said energizing piston means to expand the locking ring means creates a mechanical advantage between the energizing piston means and the lock ring means.

3. The tieback connector of claim 1 wherein said lower end of said energizing piston means includes a radiused surface which contacts a radiused surface on said lock ring means when said piston means is moved in said one direction.

4. The tieback connector of claim 3 wherein said piston means includes a portion bearing radially against a component of said inner body means when said piston means is moved in said one direction and said lock ring means bears against said wellhead component as said piston means also bears radially against said lock ring means to create said pre-load.

5. The tieback connector of claim 1 wherein said adjusting ring means deflects when said locking ring means is in locking engagement with said wellhead component.

6. The tieback connector of claim 1 wherein said energizing piston means deflects when said lock ring means is in locking engagement with said wellhead component.

7. The tieback connector of claim 1 wherein said adjustment ring means and said energizing piston means deflect when said lock ring means is in locking engagement with said wellhead component.

8. The tieback connector of claim 5 wherein the deflection of said adjusting ring means produces a compressive buckle in said adjusting ring means to provide a load force between the lock ring means and a component of said inner body means.

9. The tieback connector of claim 6 wherein the deflection of said energizing piston means provides a hoop stress in said energizing piston means to provide a load force between the lock ring means and said wellhead component.

10. The tieback connector of claim 7 wherein said deflected adjustment ring means and deflected energizing piston means are supported by rigid bodies to prevent failure of said energizing piston means and adjustment ring means during deflection.

11. The tieback connector of claim 10 wherein said support of said deflected adjustment ring means and energizing piston means by said rigid bodies in combination with the inherent compressibility of said inner body means of said tieback connector create stored energy to provide said pre-load.

12. A tieback connector for connecting a riser, conductor, or other well pipe to a subsea wellhead, said connector comprising:

(a) a tubular outer body adapted to rest axially upon an upper surface of the wellhead;

(b) an inner body adapted to extend partially into an inner diameter of said wellhead;

(c) an energizing piston extending axially between said wellhead and said inner body, said piston including actuating means disposed between said inner body and said outer body for selectively moving said piston in an axial direction;

(d) a lock ring extending circumferentially around a portion of the inner body, said lock ring disposed beneath a lower end of said energizing piston, axial movement of said energizing piston in one direction expanding the locking ring into locking engagement with a wellhead component for connecting the tieback connector to said component; and (e) an adjusting ring extending around and operatively connected to said inner body, said adjusting ring disposed beneath and in contact with a surface of said lock ring, said adjusting ring capable of axial movement to alter the axial position of said lock ring relative to said inner body to establish an adjustable pre-load on the lock ring when the lock ring is in locking engagement.

13. The tieback connector of claim 12 wherein said axial movement of said energizing piston to expand the locking ring creates a mechanical advantage between the energizing piston and the lock ring.

14. The tieback connector of claim 12 wherein said lower end of said energizing piston includes a radiused surface which contacts a radiused surface on said lock ring when said piston is moved in said one direction.

15. The tieback connector of claim 14 wherein said piston includes a portion bearing radially against a component of said inner body when said piston is moved in said one direction and said lock ring bears against said wellhead component as said piston also bears radially against said lock ring to create said pre-load.

16. The tieback connector of claim 12 wherein said adjusting ring deflects when said locking ring is in locking engagement with said wellhead component.

17. The tieback connector of claim 12 wherein said energizing piston deflects when said lock ring is in locking engagement with said wellhead component.

18. The tieback connector of claim 12 wherein said adjustment ring and said energizing piston deflect when said lock ring is in locking engagement with said wellhead component.

19. The tieback connector of claim 16 wherein the deflection of said adjusting ring produces a compressive buckle in said adjusting ring to provide a load force between the lock ring and a component of said inner body.

20. The tieback connector of claim 17 wherein the deflection of said energizing piston provides a hoop stress in said energizing piston to provide a load force between the lock ring and said wellhead component.

21. The tieback connector of claim 18 wherein said deflected adjustment ring and deflected energizing piston are supported by rigid bodies to prevent failure of said energizing piston and adjustment ring during deflection.

22. The tieback connector of claim 21 wherein said support of said deflected adjustment ring and energizing piston by said rigid bodies in combination with the inherent compressibility of said inner body of said tieback connector create stored energy to provide said pre-load.

* * * * *